US005524543A

United States Patent [19]

Kerdraon

[11] Patent Number: 5,524,543

[45] Date of Patent: Jun. 11, 1996

[54] SAFETY PRIMING SYSTEM FOR AN EXPLOSIVE CHARGE

[75] Inventor: Alain Kerdraon, Bourges, France

[73] Assignee: Giat Industries, Versailles, France

[21] Appl. No.: 392,809

[22] PCT Filed: Jun. 28, 1994

[86] PCT No.: PCT/FR94/00782

§ 371 Date: Feb. 28, 1995

§ 102(e) Date: Feb. 28, 1995

[87] PCT Pub. No.: WO95/00816

PCT Pub. Date: Jan. 5, 1995

[30] Foreign Application Priority Data

Jun. 28, 1993 [FR] France ..... 93 07825

[51] Int. Cl.[6] ..... F42C 19/10

[52] U.S. Cl. ..... 102/204; 102/223

[58] Field of Search ..... 102/204, 223, 102/228, 257

[56] References Cited

U.S. PATENT DOCUMENTS

| | | | |
|---|---|---|---|
| 4,037,537 | 7/1977 | Thorsell et al. . | |
| 4,464,990 | 8/1984 | Bendler et al. | 102/204 |
| 4,532,866 | 8/1985 | Lagofun | 102/204 |
| 4,541,342 | 9/1985 | Routledge . | |
| 4,711,177 | 12/1987 | Foster, Jr. et al. | 102/204 |
| 4,862,805 | 9/1989 | Szabo | 102/204 |
| 5,233,925 | 8/1993 | Föhl | 102/204 |

FOREIGN PATENT DOCUMENTS

| | | |
|---|---|---|
| 0040011 | 11/1981 | European Pat. Off. . |
| 2328179 | 5/1977 | France . |

*Primary Examiner*—Charles T. Jordan
*Assistant Examiner*—Theresa M. Wesson
*Attorney, Agent, or Firm*—Oliff & Berridge

[57] ABSTRACT

A priming system includes a block made of pyrotechnically inert material having on one of its surfaces a cavity placed facing an explosive charge. Structure for allowing percussion of the block is mounted at a receiving surface substantially parallel to a surface where the cavity is located. The priming system can thus be completely devoid of pyrotechnic components.

11 Claims, 3 Drawing Sheets

SAFETY PRIMING SYSTEM FOR AN EXPLOSIVE CHARGE

BACKGROUND OF THE INVENTION

The field of the present invention is that of priming systems for an explosive charge.

Ordinarily, a priming system comprises a pyrotechnic priming component (or primer) that initiates a secondary explosive booster charge, the secondary explosive booster charge providing initiation of the principal explosive charge.

The primer is a pyrotechnic component that contains a small quantity of very sensitive primary explosive. The secondary explosive booster charge is less sensitive than the primer, but can be initiated by it.

The principal drawback of known priming systems has to do with the extremely sensitive nature of the primer and the primer boosters.

Moreover, in order to initiate insensitive explosives, priming components that can deliver high energies have to be employed.

To prevent untimely detonation of explosive charges, safety and arming devices have been designed with which the primer or primer booster can be isolated from the remainder of the pyrotechnic system.

These devices are complex and costly mechanical assemblies.

Priming systems are all the more difficult to implement (and bulky) if the explosive being initiated is of the insensitive type, and thus requires substantial levels of priming energy.

SUMMARY OF THE INVENTION

One purpose of the invention is to propose a safety priming system that does not possess such disadvantages. Specifically, the priming system according to the invention allows initiation of an explosive charge without using pyrotechnic components with a primary composition, and without even using priming explosives.

Another purpose of the invention is to provide a priming system particularly well suited for safely priming of insensitive explosives.

A first aspect of the invention provides a safety priming system for an explosive charge having a block made of pyrotechnically inert material, the block having on one of its surfaces a cavity placed facing the explosive charge, and structure for allowing percussion of the block at a receiving surface substantially parallel to that on which the cavity is present.

Advantageously, the percussion structure includes a pressurizable chamber that can be filled with a compressible fluid using a supply line, one end of which chamber, arranged facing the receiving surface of the block, is closed by a sliding piston that is made integral with the chamber by connecting structure that can be unlocked by the action of a control device.

According to one particular embodiment, the connecting structure may include explosive pins.

According to another particular embodiment, the connecting structure may include pegs that are retractable by the action of an actuator.

The fluid may, for example, selected from among the following gases: air, helium, carbon dioxide, nitrogen.

According to a first embodiment, the cavity may be covered with a lining of ductile material, and the block may be made of a material whose impact impedance is greater than or equal to that of the lining.

The material of the block can be selected, for example, from the following: titanium, iron, beryllium, cobalt, aluminum.

The lining of the block can then advantageously be made of aluminum or an aluminum alloy.

According to another embodiment, the cavity may not be covered with a lining, and the block is made of a material that is ductile under impact.

In this case the material of the block can be selected from the following: aluminum, uranium, copper.

BRIEF DESCRIPTION OF THE DRAWINGS

The invention will be better understood upon reading the description below of preferred embodiments thereof, made with reference to the attached Figures that schematically depict priming system according to the inventions wherein.

DETAILED DESCRIPTION OF PREFERRED EMBODIMENTS

Figure 1:
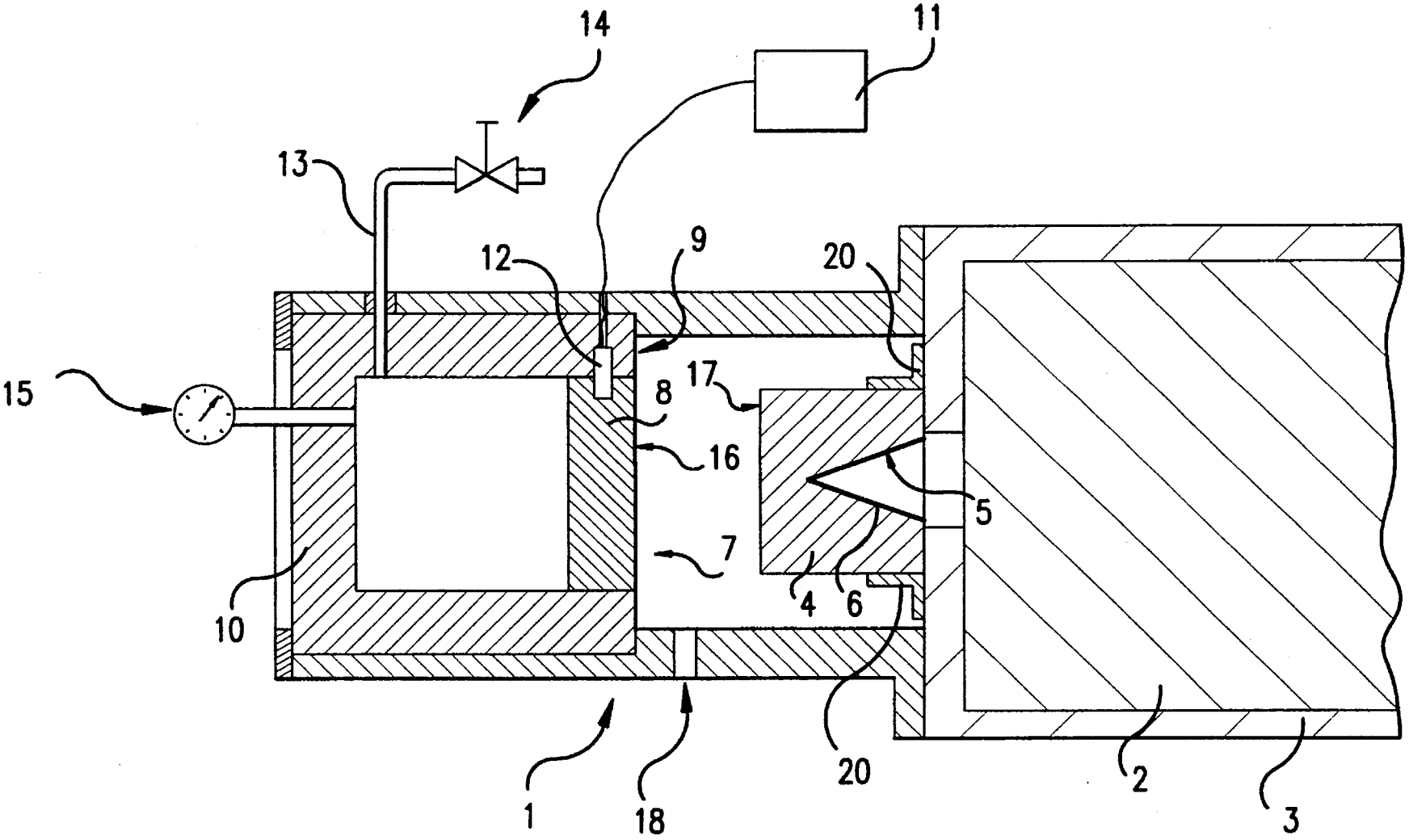
FIG. 1 shows a priming system according to a first embodiment of the invention in which a lining serves as the jetted material.

Referring to FIG. 1, a priming system 1 according to the invention is intended to initiate an explosive charge 2 that includes, for example, of a mixture of octogene (hamocyclonite) and TATB (triaminotrinitrobenzene) arranged inside a casing 3.

The priming system and the explosive are arranged inside a munition (not depicted), for example, a bomb or a missile launched by a firing platform such as an aircraft.

Priming system 1 comprises a substantially cylindrical block 4 made of a pyrotechnically inert material. The block can be made, for example, of titanium.

The block 4 possesses a substantially conical cavity 5, onto which a lining 6 is affixed, for example, by adhesive bonding.

The cavity can possess another type of concave profile (for example spherical).

In order for a jet to be able to develop, the profile of the cavity must have at every point a radius of curvature that is less than the maximum radius of the cavity.

Lining 6 will be made of a ductile material, whose impact impedance will therefore be selected to be less than or equal to that of the constituent material of block 4. For example, a lining made of aluminum or aluminum alloy can be selected.

Figure 2:
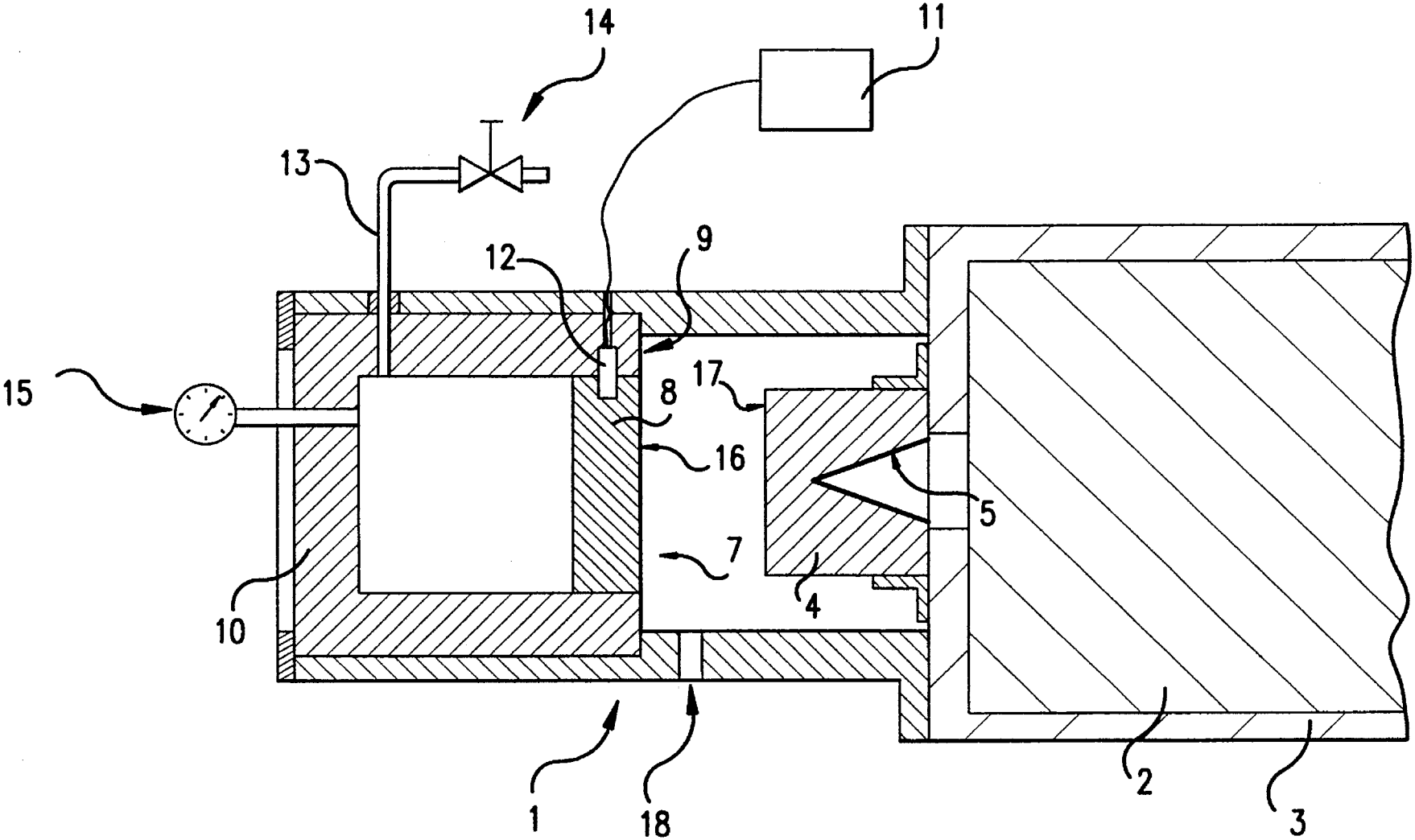
FIG. 2 shows a priming system according to a second embodiment of the present invention in which the block itself serves as the jetted material.

It is also possible that no lining is arranged in the cavity (FIG. 2). The block would then preferably be made of a material that is ductile under impact, i.e. possessing a plastic yield stress less than 500 MPa. Materials meeting this criterion are, for example, aluminum, uranium (unalloyed), and copper.

Provision of a lining makes it possible to produce a jet by applying to the block an energy level lower than that necessary to produce a jet in the absence of a lining.

As an example, it might thus be possible to combine an aluminum lining with a block whose material would be selected from the following: titanium, iron, beryllium, cobalt, aluminum.

Cavity 5 is arranged facing explosive charge 2, at a distance on the order of 20 to 50 mm. Block 4 can be fastened onto casing 3 using flanges 20, for example.

Priming system 1 also comprises percussion structure 7. The percussion structure 7 includes a piston 8 that closes one end 9 of a pressurizable chamber 10.

The piston is made integral with chamber 10 by connection structure that can be unlocked by the action of a control device 11.

The control device comprises a programmable electronic system that provides for release of the connecting structure at the moment selected for initiation of explosive charge 2. The electronic system is activated by firing or release of the munition. It performs safety functions, in particular by preventing release of the connecting structure for a sufficient time to ensure a safe distance between the munition and the firing platform.

The electronic system causes release of the connecting structure in response to a control datum, for example a signal provided by a proximity fuse or a timer. Such a control device is well known to those skilled in the art, and therefore will not be described in further detail.

In this case the connecting structure includes three explosive pins 12 that are regularly distributed angularly and are initiated by the control device.

Figure 3:
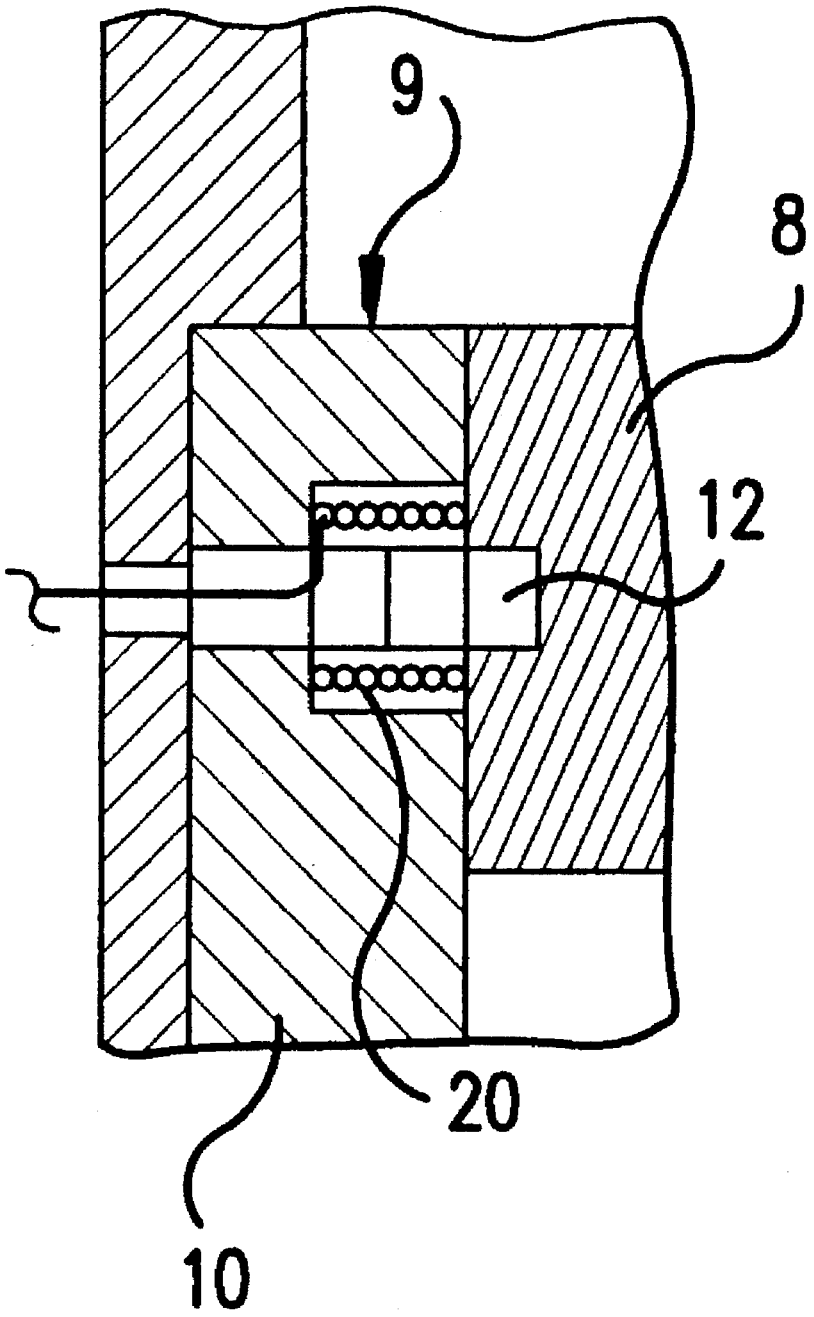
FIG. 3 shows a retractable pin that is useable with either of the first and second embodiments of the invention.

The connecting structure may comprise pins that are retractable by the action of an actuator having a spring element 30. (FIG. 3)

The actuator can be electrically controlled, and comprise in particular a motor or an electromagnet.

As a variant, the actuator can have a pneumatic control.

The chamber can be filled with a compressible fluid, for example helium, which also has the advantage of not being explosive.

The fluid is brought into the chamber through a supply line 13 that can be closed by a valve 14, a pressure gauge 15 making it possible to monitor the pressure inside chamber 10.

The percussion structure 7 is arranged in the vicinity of block 4 and piston 8 possesses one external surface 16 that is substantially parallel to a receiving surface 17 of block 4.

The priming system according to the invention operates as follows:

When the munition must be made operational, for example, when the munition is mounted on an aircraft, chamber 10 is filled with compressible fluid that is brought to the desired operating pressure.

The fluid may be put into place in chamber 10 by the aircraft pilot shortly before the munition is fired.

The control device is programmed by placing into the memories of the control device the various desired parameters: arming safety distance, operating mode (percussion, proximity, chronometric), and self-destruct timing.

When the control device intakes the explosive pins, piston 8 is no longer integral with chamber 10. The piston 8 is pushed by the pressure of the fluid and strikes receiving surface 17 of block 4.

The shock wave received by block 4 is transmitted to lining 6, that deforms and produces a jet of material that projects onto explosive charge 2 and initiates explosive charge 2.

In the event the lining is absent, it is the constituent material of the block itself that deforms at the cavity and produces the jet.

The physical phenomenon involved is analogous to that observed when a shaped-charge jet forms. In this case the inert block 4 plays the part of an explosive charge on which a lining is placed.

The energy developed by the jet is less than that utilized in shaped charges comprising a block of explosive, but it is still sufficient to allow initiation of an explosive charge.

As an example, a charge of the Octogene (homocyclonite)/TATB type can be initiated by an aluminum jet having a velocity of 6000 m/s. A jet of this kind can be produced with a 0.5 kg cylindrical block (diameter 60 mm, height 50 mm) of titanium that is struck by a piston having an energy of 60 kJ. It is easy to obtain such an energy by using a chamber filled with a fluid at a pressure of 100 MPa.

The individual skilled in the art will be able to dimension the various elements of the priming system according to the invention depending on the energy necessary to initiate the explosive charge.

It should thus be noted that the priming system according to the invention does not utilize any priming explosive. The only pyrotechnic elements include the explosive pins, but the energy that they develop is insufficient in itself to allow initiation of explosive charge 2. In addition, block 4 then acts as a protective screen, isolating the explosive charge from any spatter that might come from the pins.

The energy allowing initiation is provided by the pressurized fluid, but the pressurized fluid is not placed into the chamber 10 until the moment the munition is used.

Note, therefore, that while the munition is stored, chamber 10 is empty. In this case initiation of the explosive pins cannot lead to that of the explosive charge.

Specifically, the pins would then release the piston, which would not be pushed by the fluid and therefore cannot impact against block 4 to cause formation of a jet.

If an attempt is then made to fill chamber 10 with fluid, because piston 8 is no longer integral with the chamber it is not possible to produce the pressure necessary for proper operation of the priming system.

Failure of the piston will then be evidenced by the leakage of fluid that will flow toward the outside of the munition through one or more openings 18 provided for this purpose.

The priming system according to the invention thus makes it possible to achieve a very high level of safety.

The invention also makes it possible, in a simple and reliable manner, to ensure priming of low-sensitivity explosives such as composite explosives, for example octogene-(homocyclobite)/polyurethane or hexogene(cyclonite)/polybutadiene mixes.

The invention also makes it possible to define a modular priming system that is easily adaptable to various types of charge. All that is necessary, for example, is to modify the working pressure of the fluid to produce a different impact energy and an initiation power that is also different, but without modifying the various elements constituting the system.

As a variant, it is possible to use as percussion structure for the block various pyrotechnic modules integral with the receiving surface of the block.

Such modules would be selected so that the energy delivered by only one was insufficient to produce formation of a jet capable of initiating the explosive charge.

They would also be selected so that it was necessary to initiate all the pyrotechnic modules simultaneously to ensure formation of a jet and detonation of the charge.

An appropriate electronic control device would ensure simultaneous initiation at the desired moment.

This therefore ensures an excellent level of safety, because a single pyrotechnic module is insufficient to initiate the charge. The module is moreover isolated from the charge by the screen including the block material.

I claim:

1. A safety priming system for an explosive charge comprising:

a block made of pyrotechnically inert material, said block having on a first surface a cavity that faces an explosive charge; and a percussion structure that allows percussion at a receiving surface of said block, said receiving surface being substantially parallel to said first surface.

2. The priming system according to claim 1, wherein the percussion structure comprises a pressurizable chamber that is fillable with a compressible fluid using a supply line, and wherein one end of said chamber, which is arranged facing said receiving surface of said block, is closed by a sliding piston that is attached to said chamber using connecting structure that can be unlocked using a control device.

3. The priming system according to claim 2, wherein the connecting structure includes explosive pins.

4. The priming system according to claim 2, wherein the connecting structure includes pegs that are retractable using an actuator.

5. The priming system according to claim 2, wherein the fluid is selected from the group consisting of air, helium, carbon dioxide and nitrogen.

6. The priming system according to claim 1, wherein the cavity is covered with a ductile lining, and wherein the pyrotechnically inert material of said block has an impact impedance greater than or equal to an impact impedance of said ductile lining.

7. The priming system according to claim 6, wherein the pyrotechnically inert material of the block is selected from the group consisting of titanium, iron, beryllium, cobalt and aluminum.

8. The priming system according to claim 7, wherein the ductile lining of the cavity is made of aluminum or an aluminum alloy.

9. The priming system according to claim 1, wherein the cavity is not covered with a lining, and wherein said pyrotechnically inert material is ductile.

10. The priming system according to claim 9, wherein the ductile material of the block is selected from the group consisting of aluminum, uranium, and copper.

11. The priming system according to claim 1, further comprising a mounting structure for mounting said percussion structure, said mounting structure including at least one opening for providing an indication of fluid leaking from said percussion structure.

* * * * *